United States Patent [19]

Syori et al.

[11] Patent Number: 5,068,977

[45] Date of Patent: Dec. 3, 1991

[54] APPARATUS FOR REMOVING WATER FROM CURVED GLASS PANEL AFTER WASHING IN PRODUCTION LINE

[75] Inventors: Hideichi Syori, Matsusaka; Haruhisa Suda, Mie Pref., both of Japan

[73] Assignee: Central Glass Company, Limited, Ube, Japan

[21] Appl. No.: 560,820

[22] Filed: Jul. 31, 1990

[30] Foreign Application Priority Data

Jul. 31, 1989 [JP] Japan ..... 1-89977[U]

[51] Int. Cl.[5] ..... F26B 21/00

[52] U.S. Cl. ..... 34/54; 34/243 C; 34/229; 15/319; 15/DIG. 2

[58] Field of Search ..... 34/243 C, 56, 54, 229, 34/216-218; 15/DIG. 2, 300 R, 306 R, 319, 354, 405, 309.2

[56] References Cited

U.S. PATENT DOCUMENTS

| | | | |
|---|---|---|---|
| 2,321,983 | 6/1943 | Brackett | 15/319 |
| 2,671,241 | 3/1954 | Starner | 15/319 |
| 2,758,392 | 8/1956 | Vani et al. | 34/243 C |
| 3,409,995 | 11/1968 | Greenwood et al. | 34/243 C |
| 4,563,788 | 1/1986 | Kobayashi | 34/243 C |
| 4,667,419 | 5/1987 | Bovóne | 15/309.2 |
| 4,702,017 | 10/1987 | Lenhardt | 15/309.2 |
| 4,949,423 | 8/1990 | Larson et al. | 34/243 C |

FOREIGN PATENT DOCUMENTS

| | | |
|---|---|---|
| 52-16354 | 5/1977 | Japan . |
| 61-175886 | 11/1986 | Japan . |

*Primary Examiner*—Henry A. Bennet
*Assistant Examiner*—Denise L. F. Gromada
*Attorney, Agent, or Firm*—Fleit, Jacobson, Cohn, Price, Holman & Stern

[57] ABSTRACT

An apparatus for removing water from a curved glass panel after washing in a production line, includes nozzles which are movable upwardly and downwardly in response to variations of the height of the curved glass panel above the conveyor so as to be held at desired positions adjacent to the upper and lower surfaces of the glass panel. The nozzles are variable in inclination so as to be positioned more desiredly relative to the glass panel.

15 Claims, 3 Drawing Sheets

APPARATUS FOR REMOVING WATER FROM CURVED GLASS PANEL AFTER WASHING IN PRODUCTION LINE

BACKGROUND OF THE INVENTION

1. Field of the Invention

The present invention relates in general to cleaning of a curved glass panel in a production line, which curved glass panel is used for a laminated glass for an automobile windshield, etc., and more particularly to an apparatus for removing water from a curved glass panel after forming and washing in a production line.

2. Description of the Prior Art

It is a known technique to dry a washed glass panel by heating. A problem of this technique is that any solid substances as dirt or soil contained in water do not evapolate and remain on the glass panel after drying. Due to this, when the glass panel is joined to another glass panel to consitute a laminated glass, the solid substances will deteriorate the binding of the glass panels and an intermediate film and its appearance from the aesthetic point of view. Wiping of the glass panel to remove the residual substances therefrom is undesirable since such a wiping operation cannot be done with efficiency.

It is also a known technique to remove water from a glass panel by blowing air against it as is disclosed in Japanese Provisional Utility Model Publication No. 61-175886. By this Japanese publication, it is disclosed to wash a glass substrate for a crystalline luquid device, etc. and thereafter blow air against it with different intensities from main and auxiliary air nozzles to remove water therefrom.

Further, it is disclosed by Japanese Patent Publication No. 52-16354 to remove from a dry-cleaned glass panel dust sticking thereto by brushing and then removing a resultant static electricity by corona dischage while blowing air against it.

The above described prior art however discloses nothing about a technique for removing water from a curved glass panel after forming and washing in a production line, with ease, efficiency and assuredness.

SUMMARY OF THE INVENTION

In accordance with the present invention, there is provided a novel apparatus for removing water from a curved glass panel after washing. The apparatus comprises a conveyor for conveying a curved glass panel while holding same in such a manner that the curved glass panel is bent upwardly and have opposed ends in contact with the conveyor adjacent lateral ends thereof, a pair of air outlet units for blowing air against upper and lower surfaces of the curved glass panel, respectively and thereby driving water off therefrom, drive means for driving the air outlet units to move upwardly and downwardly, detecting means disposed forward of the air outlet units with respect to the order in which the curved glass panel conveyed by the conveyor comes thereupon, for detecting a height of the curved glass panel above the conveyor and producing a signal representative thereof, and control means responsive to the signal from the detecting means for controlling operation of the drive means and thereby holding the air outlet units at desired positions relative to the upper and lower surfaces of the curved glass panel.

The above apparatus is effective for removing water from a curved glass panel with ease, efficiency and assuredness.

It is accordingly an object of the present invention to provide an apparatus which can remove water from a curved glass panel after washing in a production line, with ease, efficiency and assuredness.

It is another object of the present invention to provide an apparatus of the above described character which can attain removal of water with a relatively low pressure of air.

It is a further object of the present invention to provide an apparatus of the above described character which can attain removal of water with a small-sized blower.

It is a further object of the present invention to provide an apparatus of the above described character which is compact in size but reliable in operation.

DESCRIPTION OF THE PREFERRED EMBODIMENTS

Figure 1A:
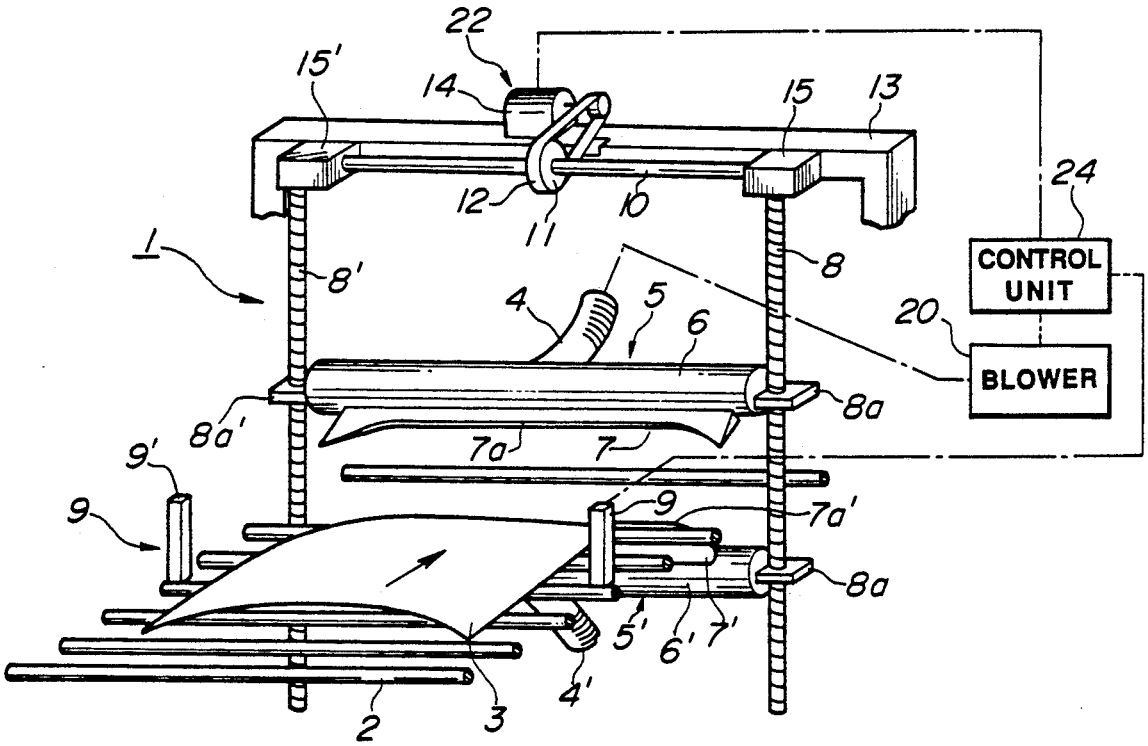
FIG. 1A is a perspective view of an apparatus for removing water from a curved glass panel after forming and washing in a production line accroding to an embodiment of the present invention.

Referring first to FIG. 1A, an apparatus according to an embodiment of the present invention is generally indicated by the reference numeral 1 and used for removing water from a curved glass panel 3 after forming and washing in a production line and thereby drying same.

The curved glass panel 3 is of the kind for constituting a laminated glass for an automobile windshield and washed by means of a shower, etc. in the production line after formed into a predetermined curved shape. In this instance, the curved glass panel 3 is held so as to be bent or curved upwardly and contact at the opposite lateral ends on a conveyor 2, i.e., the curved glass panel is bent upwardly and placed on the conveyor 2 so as to have opposite ends in contact with the conveyor 2 adjacent the lateral ends thereof. By the conveyor 2, the curved glass panel 3 is conveyed to the apparatus 1 after washing.

In the apparatus 1, compressed air from a compressed air source as a blower 20 is supplied through air ducts 4 and 4' to air outlet units 5 and 5' which blow air against the upper and lower surfaces of the curved glass panel 3. The air outlet units 5 and 5' consist of air outlet pipes 6 and 6' and nozzles 7 and 7'. The air outlet pipes 6 and 6 are disposed horizontally so as to extend crosswise of the conveyor 2 and supplied with compressed air from the blower 20 through the air ducts 4 and 4'. From the air outlet pipes 6 and 6, air is supplied to the nozzles 7 and 7' to blow against the upper and lower surfaces of the curved glass panel 3. The nozzles 7 and 7' have terminal ends 7a and 7a' elongated axially of the air outlet pipes 6 and 6', i.e., elongated crosswise of the conveyor 2. The air outlets 7a and 7a' of the nozzles 7 and 7' are curved or bent nearly or roughly correpondingly to the upper and lower surfaces of the curved glass 3, i.e., the terminal ends 7a and 7a' of the nozzles 7 and 7' are curved or bent so as to be nearly or roughly equidistant throughout its length from the upper and lower surfaces of the curved glass panel 3.

The horizontal air outlet pipes 6 and 6' are installed at opposite ends thereof on vertical drive shafts 8 and 8' by means of brackets 8a and 8a'. The brackets 8a and 8a' are movable upwardly and downardly in response to rotation of the vertical drive shafts 8 and 8' as will be described in detail hereinafter. The terminal ends of the air nozzles 7 and 7' are thus adjustable in height above the conveyor 2 so as to be positioned close to the upper and lower surfaces of the curved glass panel 3, for example, at a distance of 7 cm or less.

A photo sensor 9 has a light discharging portion 9a and a light receiving portion 9b for detecting the height of the curved glass 3 above the conveyor 2 and producing a signal reprsentative thereof. In response to the signal produced by the photo sensor 9, the air outlet units 5 and 5' are driven to move upwardly and downwardly by a drive unit 22 as will be described hereinafter.

The drive unit 22 includes a horizontal drive shaft 10 rotatably installed on a frame 13 of the apparatus 1 and extending between the upper ends of the vertical shafts 8 and 8', a pulley 11 installed on the horizontal drive shaft 10 to rotate therewith and a motor 14 installed on the frame 13 of the apparatus 1 and drivingly connected to the pully 11 by way of a belt 12 for rotating the horizontal drive shaft 10 in the opposite directions. The horizontal drive shaft 10 is drivingly connected at the opposite ends with the upper ends of the vertical drive shafts 8 and 8' by means of worm gear and worm wheel assemblies 15 and 15' such that rotation of the horizontal drive shaft 10 is transmitted to the vertical drive shafts 8 and 8' to rotate same.

The movable brackets 8a and 8a' at the opposite ends of the air outlet pipes 6 and 6' have threaded holes for receiving therein the correspondingly threaded vertical drive shafts 8 and 8' so that the brackets 8a and 8a' and the vertical drive shafts 8 and 8' are threadedly engaged with each other, i.e, the bracekts 8a and 8a' are threadedly engaged with the vertical drive shafts 8 and 8' such that rotation of the vertical drive shafts 8 and 8' in the opposite directions causes the brackets 8a and 8a' to move upwardly and downwardly together with the air outlet units 5 and 5'.

Figure 1B:
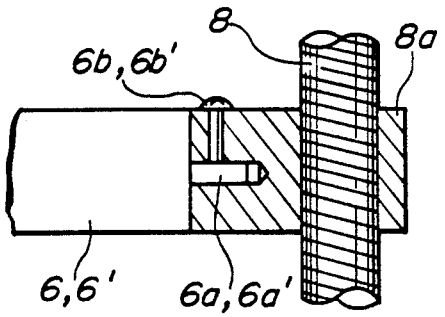
FIG. 1B is a fragmentary elevational view of an air outlet pipe and a bracket of the apparatus of FIG. 1A.

As shown in FIG. 1B, the air outlet pipes 6 and 6' have at the opposite ends pivot shafts 6a and 6a' and are rotatably installed thereat on the brackets 8a and 8a'. By this, the nozzles 7 and 7' are rotatable together with the air outlet pipes 6 and 6' so as to adjust the inclination thereof. The air outlet pipes 6 and 6' are held fixed or stationary in the adjusted positions by means of screws 6b and 6b' screwed onto the brackets 8a and 8a'.

In operation, when the curved glass panel 3 is conveyed to the appratus 1, the photo sensor 9 detects the height of the curved glass panel 3 above the conveyor 2 and supplies a signal representative thereof to a control unit 24. In response to the signal from the photo sensor 9, the control unit 24 actuates the motor 14 and thereby rotates the horizontal drive shaft 10 just before the curved glass 3 comes to the place between the nozzles 7 and 7'. Rotation of the horizontal drive shaft 10 causes the vertical drive shafts 8 and 8' to rotate and thereby move the air outlet units 5 and 5' upwardly or downwardly into desired positions corresponding to the detected height of the curved glass panel 3. Simultaneously with the above operation of the drive unit 22, the blower 20 is actuated to supply compressed air to the air outlet units 5 and 5' and thereby blow air against the upper and lower surfaces of the curved glass panel 3 through the nozzles 7 and 7'.

In response to a variation of the height of the curved glass panel 3, the photo sensor 9, drive unit 22 and control unit 24 operate similarly to the above described manner and cause the air outlet units 5 and 5' to move upwardly or donwardly into desired positions and thereby remove water from the curved glass panel 3 with efficiency. When the curved glass panel 3 passes through the apparatus 1, the apparatus 1 is stopped to finish a water removing operation. When another curved glass panel 3 is conveyed by the conveyor 2 to the apparatus 1, the apparatus 1 is started to perform the above described operation again.

While the above describved embodiment is constructed so that the upper and lower air outlet units 5 and 5' are moved upwardly and downwardly while maintaining a predetermined distance therebetween and being held in a parallel relation to each other, the air outlet units 5 and 5' may otherwise be controlled so as to move independently to each other.

Figure 2A:
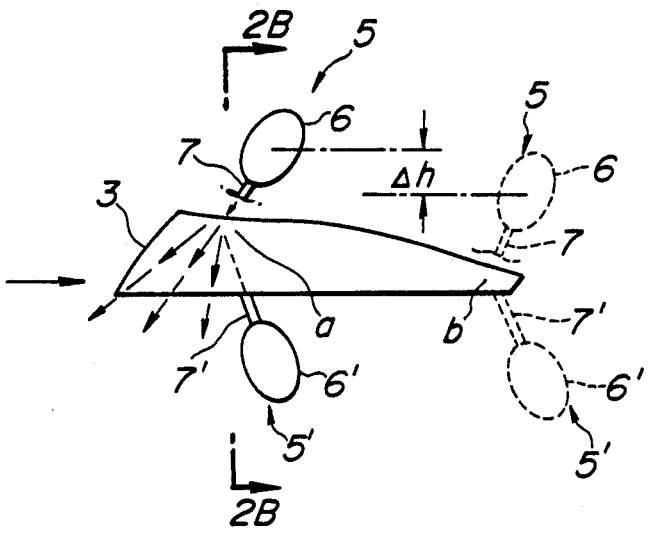
FIG. 2A is a schematic side elevational view of air outlet pipes and nozzles of the apparatus of FIG. 1.
Figure 2B:
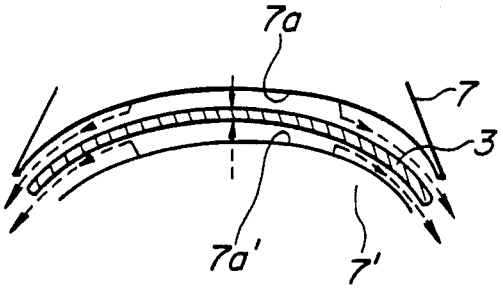
FIG. 2B is a sectional view taken along a line 2B—2B of FIG. 2A.
Figure 2C:
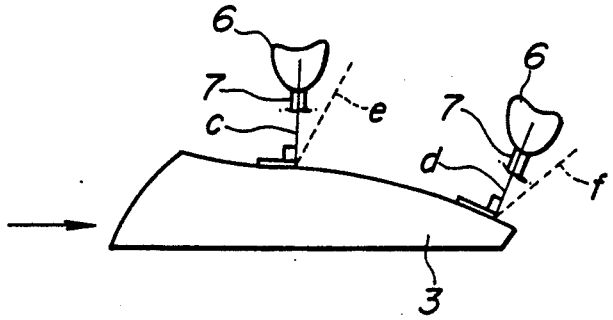
FIG. 2C is a view similar to FIG. 2A but shows more in detail an inclination of the upper nozzle of the apparatus of FIG. 1 relative to the curved glass panel.

Referring to FIGS. 2A to 2C, the air outlet units 5 and 5' move a distance $\Delta h$ in response to a variation of the height of the curved glass panel 3 between the portions "a" and "b" thereof such that the terminal ends 7a and 7a' of the nozzles 7 and 7' are positioned desiredly relative to the curved glass panel 3, and the nozzles 7 and 7' are held inclined so as to blow air in the opposite direction of conveyance of the curved glass panel 3 as indicated by the arrows in FIG. 2A. In this instance, as shown in FIG. 2C, the nozzle 7 is held so as to blow air in the direction coincident with the normal line "c" or "d" of an associated upper surface portion of the curved glass panel 3 or in the direction inclined from the normal line "c" or "d" toward the direction of conveyance of the curved glass panel 3 as indicated by the dotted lines "e" and "f". The above arrangement of the nozzle 7 is applied similarly to the nozzle 7'. Further, the nozzles 7 and 7' are constructed so as to blow air toward the downwardly curved end portions of the curved glass panel 3 as indicated by the arrows in FIG. 2B. The air outlet units 5 and 5' of the above structure are effective for driving water off from the upper and lower surfaces of the curved glass panel 3 and therefore capable of removing water therefrom with efficiency.

Figure 3:
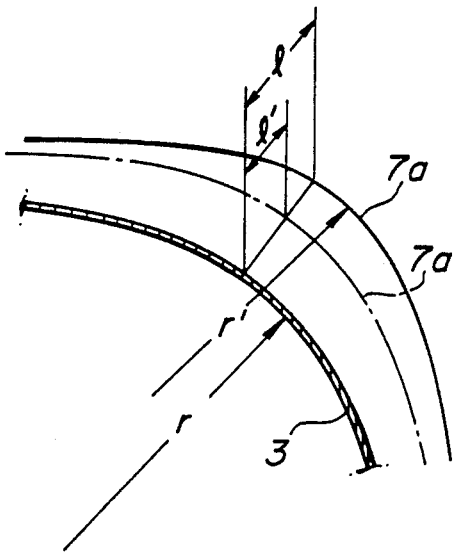
FIG. 3 is a schematic sectional view showing a relative disposition of the terminal end of the upper nozzle and the curved glass panel in the apparatus of FIG. 1.

In FIG. 3, assuming that the radius of curvature of a portion of the curved glass 3 is r and the radius of curvature of a corresponding portion of the terminal end 7a of the nozzle 7 is r', the terminal end 7a of the nozzle 7 is shaped so as to satisfy the relational expression $r > r'$. When the above described portion of the nozzle 7 is disposed normal to the corresponding portion of the curved glass panel 3, a distance l is obtained between the portions of the curved glass panel 3 and nozzle 7. However, when inclined, the nozzle 7 can be held in the position as indicated by the one dot chain line in FIG. 3 to attain a less distance l' between the portions of the curved glass panel 3 and nozzle 7, thus making it possible to drive water off from the curved glass 3 with more efficiency. The above arrangement is applied similarly to the nozzle 7'.

In this manner, the terminal ends 7*a* and 7*a*' of the nozzles 7 and 7' can go nearer to the upper and lower surfaces of the curved glasss panel 3 of various radii of curvature so long as the relational expression $r>r'$ is satisfied.

In the above described embodiment, the inclinations of the nozzles 7 and 7' are fixed for the same glass panel 3 though adjustable. Accordingly, when the curved glass panel 3 varies in the radius of curvature from portion to portion, it is impossible to hold the nozzles 7 and 7' at optimum positions relative to the curved glass panel 3 throughout its length.

Figure 4:
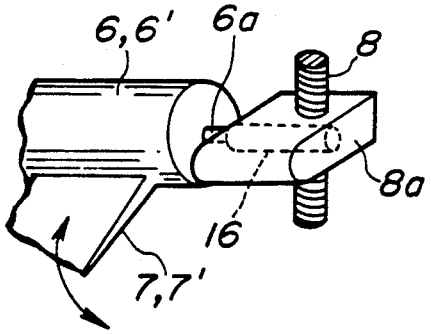
FIG. 4 is a fragmentary perspective view of an air outlet pipe and a bracket according to a modification of this invention.

FIG. 4 shows a modification in which a motor 16 is installed or embedded in the bracket 8*a* and drivingly connected to one of pivot shafts 6*a* fixed to opposite ends of the air outlet pipe 6 such that the nozzle 7 is swingably installed on the bracket 8. By program-controlling the swinging of the nozzle 7 by means of the control circuit 24, the nozzle 7 can be held in an optimum inclined position in response to a variation in radius of curvature of the curved glass panel 3, whereby to hold the terminal end 7*a* thereof desiredly adjacent to the curved glass panel 3. The above arrangement is applied similarly to the air outlet pipe 6'. In this instance, the control unit 24 is provided with a control circuit in which the target heights and inclinations of the nozzles 7 and 7' at various portions of the curved glass 3 are programed such that in response to a signal from the photo sensor 9 the control unit 24 actuates the motor 14 in FIG. 1 and the motor 16 in FIG. 4 for thereby moving the nozzles 7 and 7' upwardly or downwardly and inclining the same into predetermined positions.

In the meantime, in case of a curved glass panel for an automative vehicle windshield, a variation of height h between the positions "a" and "b" of the glass panel 3 in FIG. 2A will exceed 15 cm in many cases. In such a case, the distance between a nozzle and its associated portion of the glass panel will inevitably exceed 15 cm if the nozzle is held fixed or stationary. In this case, an air pressure higher than 500 mmAq is necessitated for driving water off from the glass panel.

With a movable nozzle, the distance between the nozzle and the glass panel can be less than half of that in case of a stationary nozzle, i.e., less than 7 cm, and therefore removal of water from the glass panel can be attained with an air pressure less than 220 mmAq. Further, with a swingable nozzle, the distance in question can be less than ⅓ of that in case of a stationary nozzle, i.e., less than 5 cm, and a necessitated air pressure at the nozzle can be less than 150 mmAq, thus making it possible for the blower 20 and threfore the apparatus to be compact in size and for the appratus 1 to operate with improved efficiency.

What is claimed is:

1. An apparatus for removing water from a curved glass panel after washing, comprising:

a conveyor for conveying a curved glass panel while holding same in such a manner that the curved glass panel is bent upwardly and has opposite ends in contact with said conveyor adjacent lateral ends thereof;

a pair of air outlet units for blowing air against upper and lower surfaces of the curved glass panel, respectively, and thereby driving water off therefrom;

first drive means for driving said air outlet units to move upwardly and downwardly;

detecting means disposed forward of said air outlet units with respect to the order in which the curved glass panel conveyed by said conveyor comes thereupon, for detecting a height of the curved glass panel above said conveyor and producing a signal representative thereof;

control means responsive to the signal from said detecting means for controlling operation of said first drive means and thereby holding said air outlet units at desired positions relative to the upper and lower surfaces of the curved glass panel;

said air outlet units having nozzles disposed adjacent the upper and lower surfaces of the curved glass panel, said nozzles having terminal ends elongated crosswise of said conveyor and curved corresponding to said curved glass panel;

said air outlet units further having pivot means for allowing said nozzles to swing in the direction of conveyance of the curved glass panel; and second drive means for driving said nozzles to swing in response to variation in curvature of the glass panel.

2. The apparatus as claimed in claim 1 wherein said detecting means detects a variation of the height of the curved glass panel and producing a signal representative thereof, and said control means is responsive to said signal representative of said variation.

3. The apparatus as claimed in claim 2, further comprising means for producing compressed air and supplying it to said air outlet units under control of said control means.

4. The apparatus as claimed in claim 3, wherein said air outlet units further comprise horizontal air outlet pipes extending crosswise of said conveyor and disposed between said compressed air producing means and said nozzles to provide communication therebetween.

5. The apparatus as claimed in claim 4 wherein said first drive means comprises a pair of vertical drive shafts on the opposite sides of said conveyor and a pair of movable brackets having threaded openings and installed on said vertical drive shafts which are correspondingly threaded such that rotations of said drive shafts in opposite directions cause said brackets to move upwardly and downwardly, said air outlet pipes being rotatably supported at opposite ends thereof on said brackets by means of said pivot means, said nozzles being respectively attached to said air outlet pipes to rotate together therewith.

6. The apparatus as claimed in claim 5 wherein said air outlet pipes are movable upwardly and downwardly while maintaining a predetermined distance therebetween.

7. The apparatus as claimed in claim 6 wherein said pivot means pivotally supports said air outlet pipes on said brackets such that said nozzles are variable in inclination relative to the curved glass panel.

8. The apparatus as claimed in claim 7 wherein each of said air nozzles is disposed so as to blow air in the direction coincident with a normal line of an associated portion of the glass panel or in the direction inclined away from said normal line toward the direction of conveyance of the curved glass panel.

9. The apparatus as claimed in claim 8 wherein each of said nozzles is constructed so as to blow air toward said end portions of the curved glass panel.

10. The apparatus as claimed in claim 9 wherein said pivot means comprises pivot shafts attached to opposite ends of said air outlet pipes, respectively, and said second drive means comprises motors connected to said pivot shafts at one end of said air outlet pipes and embedded in said brackets, said pivot shafts at the other end of said air outlet pipes being rotatably installed on said brackets, said motor being operatively connected to said control means to be controlled thereby such that said one nozzle is variable in inclination in response to a variation in a radius of curvature of an associated portion of the glass panel.

11. The apparatus as claimed in claim 10 wherein the curved glass panel has a curved portion of a radius of curvature r, and one of said nozzles has a curved portion to be mated with the curved portion of the glass panel and of a radius of curvature 4', said one nozzle being constructed so as to satisfy the relational expression $r > 4'$.

12. The appratus as claimed in claim 10 wherein said air outlet pipes have at the opposite ends pivot shafts which are rotatably installed in said brackets, said shafts of said air outlet pipes being rotationally fixed to said brackets after adjustment of inclination of said air outlet pipes.

13. The apparatus as claimed in claim 10 wherein said first drive means further comprises a horizontal drive shaft and worm gear and worm wheel assemblies for drivingly connecting opposite ends of said horizontal drive shaft to upper ends of said vertical drive shafts.

14. The apparatus as claimed in claim 13 wherein said first means further comprises a pulley installed on said horizontal drive shaft to rotate therewith and a motor drivingly connected to said pulley by way of a belt.

15. The apparatus as claimed in claim 1 wherein said detecting means comprises a photo sensor.

* * * * *